US010195862B2

(12) United States Patent
Roman et al.

(10) Patent No.: US 10,195,862 B2
(45) Date of Patent: Feb. 5, 2019

(54) OFF-AXIS PRINTHEAD ASSEMBLY ATTACHABLE TO A CARRIAGE

(71) Applicant: Hewlett-Packard Development Company, L.P., Houston, TX (US)

(72) Inventors: Justin M. Roman, Portland, OR (US); Raymond Ehlers, Corvallis, OR (US); Sam Sing, Vancouver, WA (US); Jeffrey G. Bingham, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/570,216

(22) PCT Filed: Jun. 11, 2015

(86) PCT No.: PCT/US2015/035302

§ 371 (c)(1),
(2) Date: Oct. 27, 2017

(87) PCT Pub. No.: WO2016/200388

PCT Pub. Date: Dec. 15, 2016

(65) Prior Publication Data

US 2018/0134041 A1 May 17, 2018

(51) Int. Cl.
*B41J 25/34* (2006.01)
*B41J 2/175* (2006.01)

(52) U.S. Cl.
CPC ..... *B41J 2/17523* (2013.01); *B41J 2/175* (2013.01); *B41J 2/1752* (2013.01); *B41J 2/17509* (2013.01); *B41J 2/17553* (2013.01); *B41J 25/34* (2013.01)

(58) Field of Classification Search
CPC .. B41J 2/1752; B41J 2/17523; B41J 2/17553; B41J 25/34
See application file for complete search history.

(56) References Cited

U.S. PATENT DOCUMENTS 5,329,294 A * 7/1994 Ontawar ..... B41J 2/17506 347/87
6,003,981 A 12/1999 Cameron et al.
6,003,982 A 12/1999 Curley
(Continued)

FOREIGN PATENT DOCUMENTS

CN 201960832 9/2011

OTHER PUBLICATIONS

Brother, Inkjet Printing, Color Inkjet Multi-Function Centres downloaded Apr. 1, 2015 (2 pages) welcome.brother.com/sg-en/our-technology/printing-imaging/inkjet-printing.tab2.html.

*Primary Examiner* — Anh T. N. Vo
(74) *Attorney, Agent, or Firm* — Trop Pruner & Hu PC

(57) ABSTRACT

An off-axis printhead assembly includes a printhead body that has an engagement element removably attachable to an attachment mechanism of a carriage of a printing system, the attachment mechanism of the carriage removably attachable to an on-axis printhead assembly. A fluid conduit interconnect is removably attached to the printhead body, the fluid conduit interconnect to connect to a fluid conduit to communicate printing fluid from at least one off-axis printing fluid supply through the fluid conduit interconnect to the printhead body.

20 Claims, 11 Drawing Sheets

(56) References Cited

U.S. PATENT DOCUMENTS

| | | | | |
|---|---|---|---|---|
| 6,494,630 | B2 * | 12/2002 | Williams | B41J 2/1752 347/20 |
| 6,511,165 | B1 | 1/2003 | Barinaga et al. | |
| 6,623,105 | B1 | 9/2003 | Shen | |
| 6,736,495 | B2 * | 5/2004 | Wu | B41J 2/175 347/85 |
| 7,255,423 | B2 | 8/2007 | Silverbrook et al. | |
| 7,537,312 | B2 * | 5/2009 | Sekino | B41J 2/17513 347/49 |
| 7,712,986 | B2 * | 5/2010 | DeVore | B41J 2/1752 347/49 |
| 7,997,698 | B2 | 8/2011 | Davis et al. | |
| 8,113,637 | B2 | 2/2012 | Yokouchi | |
| 2003/0142176 | A1 | 7/2003 | Wu et al. | |
| 2004/0246284 | A1 | 12/2004 | Murai et al. | |
| 2005/0069370 | A1 | 3/2005 | Yamada et al. | |
| 2012/0268535 | A1 | 10/2012 | Gomez et al. | |
| 2013/0335466 | A1 | 12/2013 | Olsen et al. | |

* cited by examiner

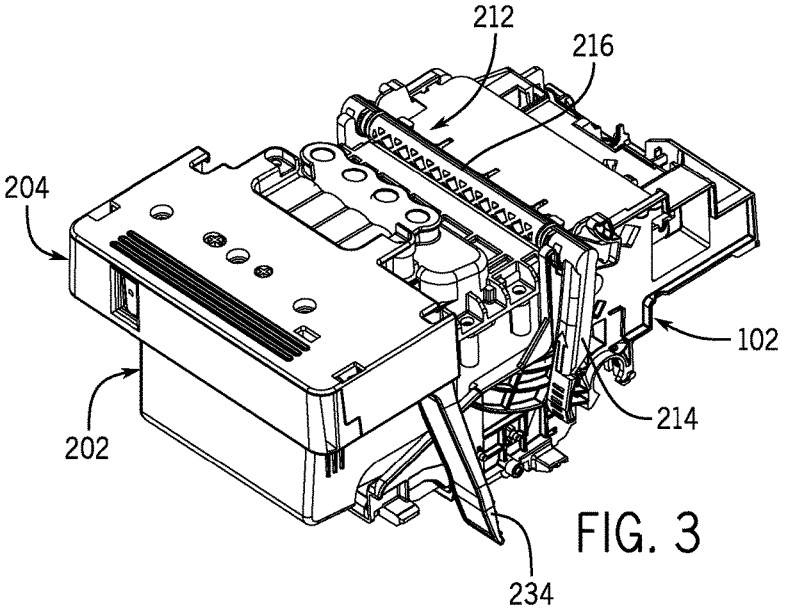
FIG. 3
FIG. 4
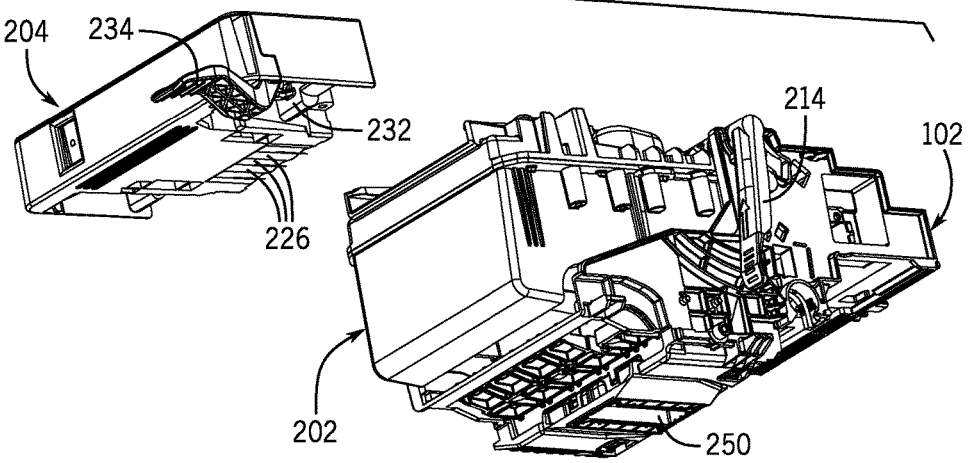

OFF-AXIS PRINTHEAD ASSEMBLY ATTACHABLE TO A CARRIAGE

BACKGROUND

A printing system can be used to print images and/or text onto a print medium or print target. A printing system can include a moveable carriage to which a printhead assembly is attached. During operation of the printing system, the printhead assembly is able to deliver printing fluid to the print medium or print target.

BRIEF DESCRIPTION OF THE DRAWINGS

Some implementations of the present disclosure are described with respect to the following figures.

FIGS. 2 and 3 are perspective top views of an example arrangement that includes a carriage and an off-axis printhead assembly (PHA) that includes a printhead body and a fluid conduit interconnect, according to some implementations.

FIG. 4 is a bottom perspective view of the example arrangement including the carriage and the off-axis PHA, according to some implementations.

DETAILED DESCRIPTION

Figure 1:
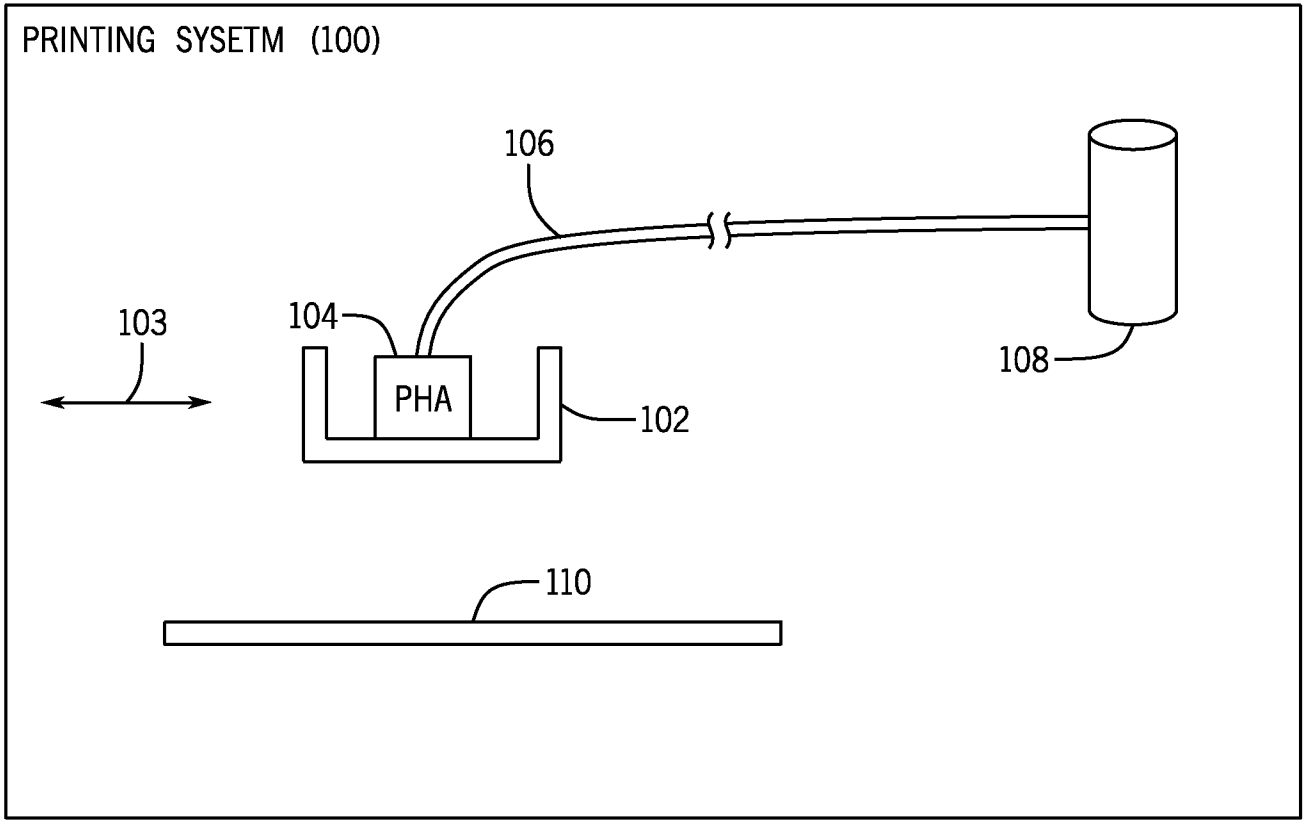
FIG. 1 is a block diagram of an example printing system according to some implementations.

A printing system for printing text and/or images onto print media can include either an on-axis or an off-axis printing fluid supply system. Although reference is made to a "print medium," it is noted that techniques or mechanisms according to the present disclosure can also be used with a three-dimensional (3D) print target (which can include a bed of print material, for example). Note also that the "printing system" can be a two-dimensional (2D) printing system or a 3D printing system. An on-axis printing fluid supply system includes one or multiple printing fluid supplies that are installed on a printhead assembly. A printing fluid supply includes a container that holds printing fluid that is to be delivered to the printhead assembly. A printhead assembly can include one or multiple printing fluid ejectors to eject printing fluid (received from the one or multiple printing fluid supplies) onto a print medium during operation of the printing system. A printing fluid can include ink (black ink and/or color ink), or other types of printing fluid. A print medium can include paper, a transparency foil, or any other medium onto which printing fluid can be deposited to form image(s) and/or text. More generally, a print target can refer to either a 2D print medium or a 3D structure on which 3D printing can be performed.

The printhead assembly can be attached to a moveable carriage of the printing system. During operation of the printing system, the moveable carriage of the printing system can move back and forth with respect to the print medium as printing fluid is deposited onto the print medium. With an on-axis fluid printing supply system, the printing fluid supply or supplies installed in the printhead assembly moves with the carriage.

An off-axis printing supply system includes one or multiple printing fluid supplies that are separated from the printhead assembly, and can be attached to another part of the printing system (or even outside of and away from the printing system) such that the printing fluid supply or supplies is (are) stationary with respect to the printhead assembly and carriage during operation of the printing system when the printhead assembly and carriage are moved back and forth to print onto a print medium. A print conduit (which can include one or multiple flexible tubes or other types of fluid communication structures) is used to communicate printing fluid between each respective printing fluid supply and the printhead assembly.

In some example printing systems, different carriage designs are provided for respective on-axis and off-axis printing fluid supply systems. For example, a carriage designed for an off-axis printing fluid supply system may be different from a carriage designed for an on-axis printing fluid supply system, since the carriage for the off-axis printing fluid supply system has to accommodate fluid conduits (e.g. tubes) from the off-axis printing fluid supplies. Having to reconfigure a carriage design to operate with an off-axis printing fluid supply system can add cost and time delay to the development of printing systems. In addition, the reconfiguring of the carriage design can increase the size of a printing system, such as due to adding anchor points for fluid conduits and providing make-break connection mechanisms.

In accordance with some implementations of the present disclosure, an off-axis printhead assembly is provided that can be used with a carriage of a printing system that also is arranged to accommodate an on-axis printhead assembly. An off-axis printhead assembly can refer to a printhead assembly that is connected over a fluid conduit (e.g. including one or multiple tubes) to a respective at least one printing fluid supply that is arranged in an off-axis manner (in other words, the printing fluid supply is provided away from the printhead assembly such that the printing fluid supply is stationary while the printhead assembly moves with the carriage during operation of the printing system). An on-axis printhead assembly can refer to a printhead assembly in which at least one printing fluid supply is installed on the printhead assembly, such that the printing fluid supply moves with the printhead assembly during printing operation of the printing system.

By using a common carriage design to accommodate either an off-axis printhead assembly or an on-axis printhead assembly, cost savings and development time reduction can be achieved for the development of printing systems. In accordance with some implementations of the present disclosure, a carriage designed for an on-axis printhead assembly can also be used with an off-axis printhead assembly, such that complexities associated with having to re-design a carriage for the off-axis printhead assembly can be avoided.

FIG. 1 illustrates an example printing system 100 that includes a moveable carriage 102, which can be translated back and forth along an axis 103. The carriage 102 is able to receive an off-axis printhead assembly (PHA) 104, which is attached by a fluid conduit 106 to a respective at least one printing fluid supply 108. In some examples, the printing system 100 can include multiple printing fluid supplies 108 that are interconnected by the fluid conduit 106 to the off-axis PHA 104. The printing fluid supplies can contain printing fluid, such as ink. In such examples, the fluid conduit 106 can be a flexible ribbon that includes multiple tubes or fluid paths for interconnecting the printing fluid supplies 108 to the off-axis PHA 104.

In accordance with some implementations of the present disclosure, the carriage 102 is a carriage that is designed to receive an on-axis PHA. Without changing the design of the carriage 102, the carriage 102 is also able to receive the off-axis PHA 104.

During operation of the printing system 100, the carriage 102 with the off-axis PHA 104 mounted can be moved back and forth along axis 103 to print onto a print medium 110.

Note that in other implementations, the carriage 102 can be a stationary carriage that extends across a width of a print medium. In other examples, the print medium may be moveable relative to the stationary carriage. More generally, the printing system 100 can perform printing (2D printing or 3D printing) onto a print target.

Figure 2:
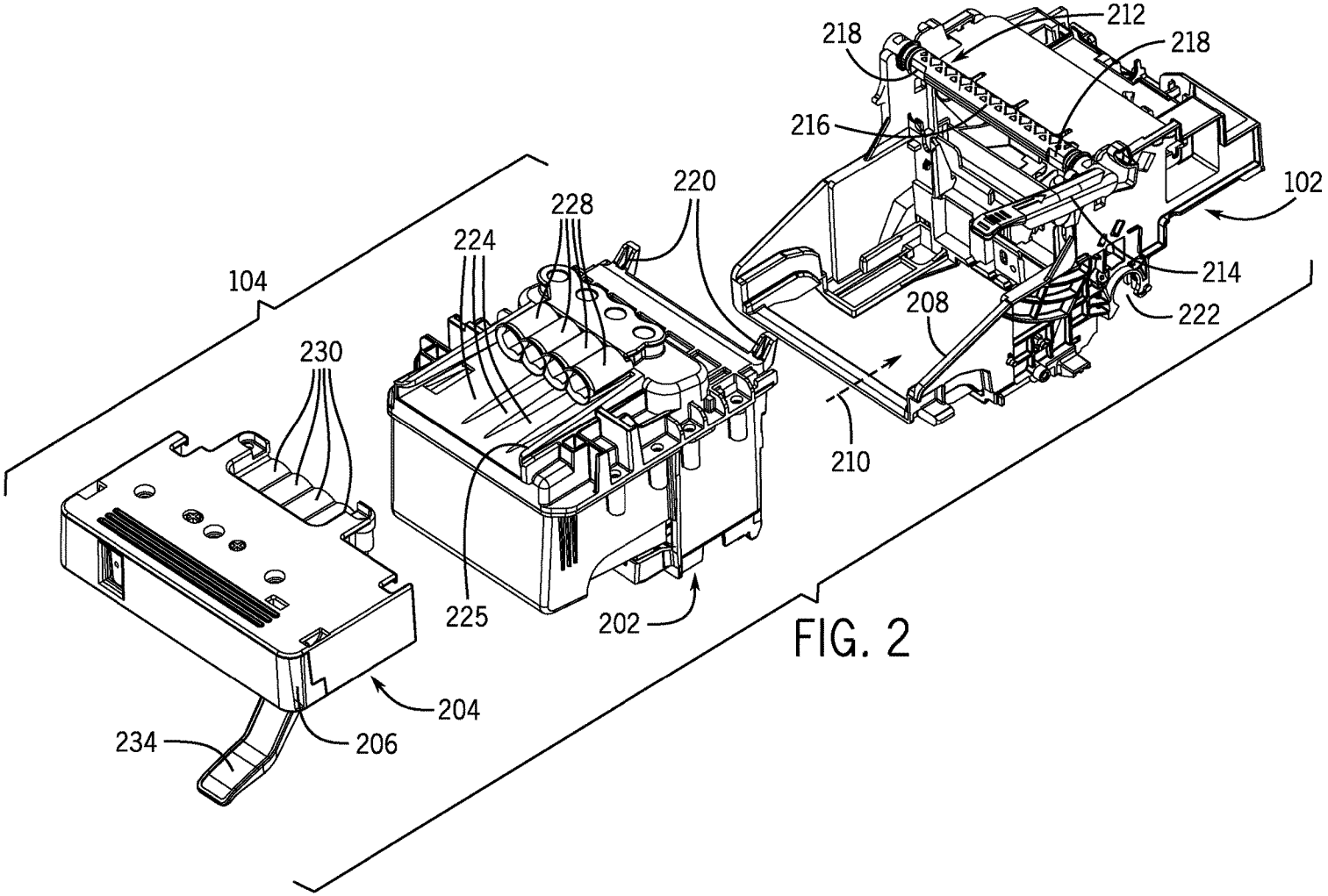

The following discussion is made in connection with FIGS. 2-4 and 5A-5C. FIG. 2 is a top perspective view of an example arrangement that includes the carriage 102 and the off-axis PHA 104 according to some implementations, where the off-axis PHA 104 is not yet mounted in the carriage 102. FIG. 3 is a top perspective view of the example arrangement with the off-axis PHA 104 mounted in the carriage 102. FIG. 4 is a bottom perspective view of the example arrangement with a printhead body 202 of the off-axis PHA 104 mounted in the carriage 102, but a fluid conduit interconnect 204 of the off-axis PHA 104 is detached from the printhead body 202.

Figure 5A:
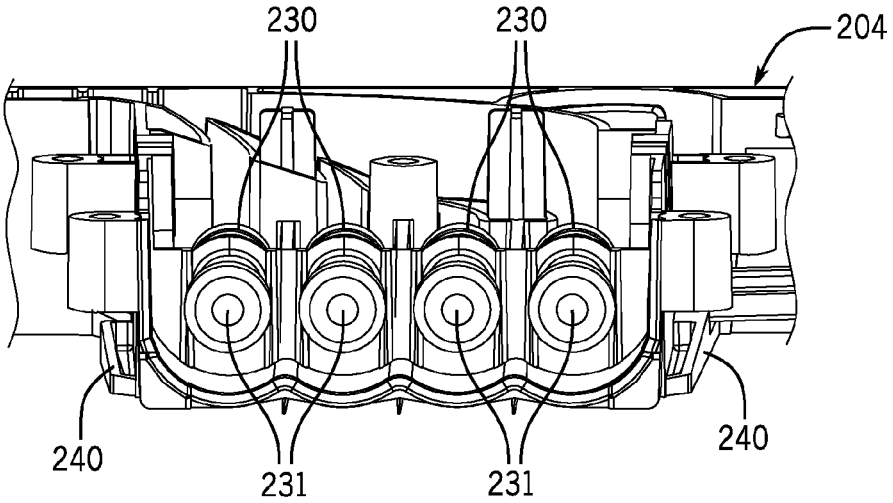
FIGS. 5A-5C depict example fluid connecting elements of the printhead body and the fluid conduit interconnect, according to some implementations.
Figure 5B:
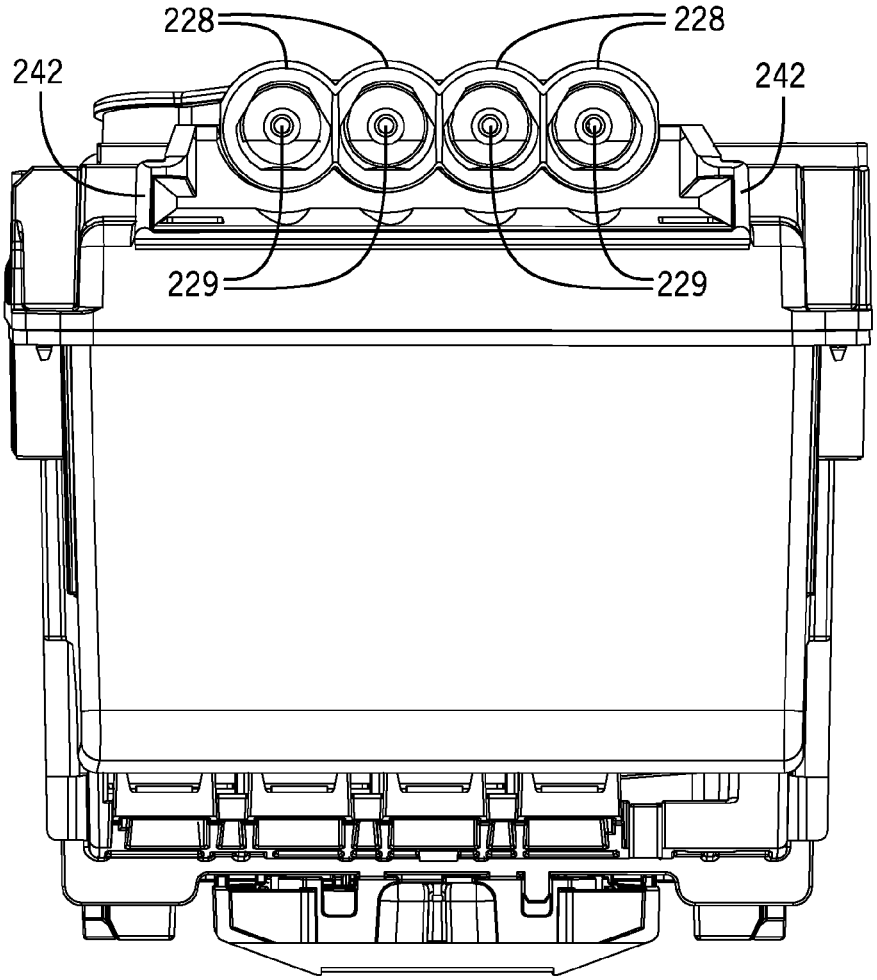
Figure 5C:
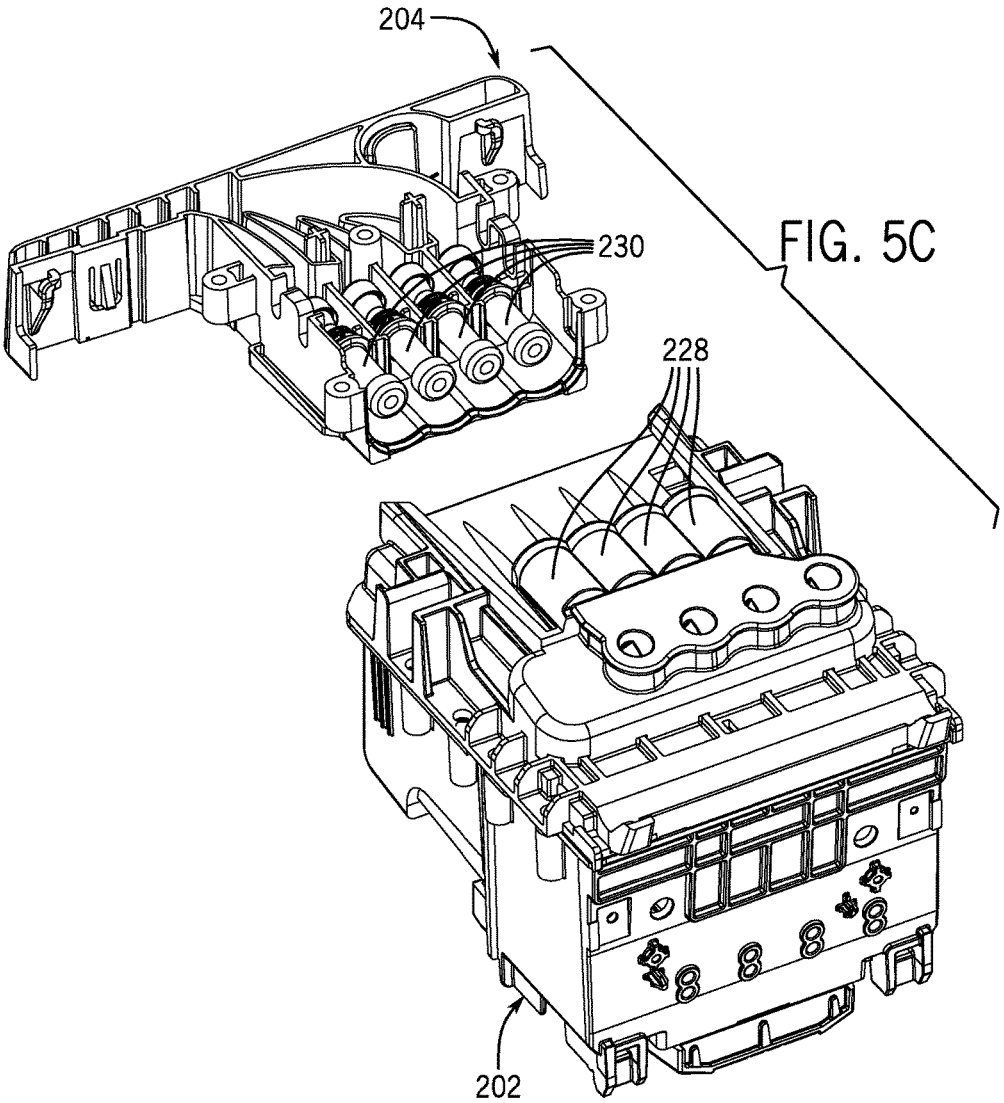

FIG. 5A is a rear elevational view of the fluid conduit interconnect 204 of the off-axis PHA 104, and FIG. 5B is a front elevational view of the printhead body 202 of the off-axis PHA 104. FIG. 5C shows aligning of the fluid conduit interconnect 204 with the printhead body 202 of the off-axis PHA 104. Note that in FIGS. 5A and 5C, outer housing portions have been removed from the fluid conduit interconnect 204 to depict components inside the fluid conduit interconnect 204.

The off-axis PHA 104 includes the printhead body 202 and the fluid conduit interconnect 204 that is removably attachable to the printhead body 202. The fluid conduit interconnect 204 includes a receptacle 206 that can be connected to the fluid conduit 106 (shown in FIG. 8).

The carriage 102 has a printing system shaft receptacle 222 that can be mounted onto a shaft of the printing system 100 to allow the carriage 102 to be moveable along the shaft (not shown) during operation of the printing system 100.

The carriage 102 has a receptacle 208 for receiving the printhead body 202 of the off-axis PHA 104. The receptacle 208 has an opening to allow the printhead body 202 to be mounted from the front (210) of the carriage 102. In some implementations, allowing the printhead body 202 to be mounted into the receptacle 208 from the front 210 of the carriage 102 allows for a more convenient mounting arrangement of the printhead body 202 in the carriage 102, as compared to an arrangement in which the printhead body 202 of the off-axis PHA 104 is mounted through the top portion of the carriage 102. Note, however that in other implementations, the printhead body 202 of the off-axis PHA 104 can be mounted through the top portion of the carriage 102.

In some implementations, the carriage 102 has a latch mechanism 212 that includes a moveable lever 214 (or other type of moveable member) that can be actuated by a user between an unlocked position (the position shown in FIG. 2) and a locked position (the position shown in FIGS. 3 and 4). The latch mechanism 212 has a rotatable latch spindle 216 with latch openings 218 for receiving respective engagement members 220 of the printhead body 202. In some implementations, the engagement members 220 can be in the form of protrusions (e.g. horns) that can be received in the latch openings 218 of the latch spindle 216.

In other examples, protrusions can be provided on the rotatable latch spindle 216, and openings can be provided on the printhead body 202 of the off-axis PHA 104. More generally, the latch mechanism 212 has at least one engagement member that is able to engage with a respective at least one engagement member of the printhead body 202 to engage the off-axis PHA 104 in the carriage 102.

Once the printhead body 202 is received in the receptacle 208 of the carriage 102, rotation of the latch spindle 216 due to user actuation of the lever 214 causes the latch openings 218 to engage the engagement members 220 of the printhead body 202, such that once the lever 214 is moved to its locked position (FIGS. 3 and 4), the engagement members 220 are fully received in the latch openings 218 such that the printhead body 202 of the off-axis PHA 104 is locked in position with respect to the carriage 102.

Although a specific latching mechanism 212 for engaging the engagement members 220 of the printhead body 202 is shown in FIGS. 2-4, it is noted that in other examples, other types of latching mechanisms for engaging the printhead body 202 can be used.

Also, although the latching mechanism 212 is shown as being part of the carriage 102, it is noted that in other examples, the latching mechanism 212 can be provided on the printhead body 202, for latching engagement members on the carriage 102.

More generally, the carriage 102 has an attachment mechanism that is removably attachable to an engagement element of the off-axis PHA 104. The attachment mechanism can be the latch mechanism 216, or alternatively, can be any type of attachment element, such an attachment element engageable with a latch mechanism provided on the off-axis PHA 104.

FIG. 2 shows the fluid conduit interconnect 204 of the off-axis PHA 104 separated from the printhead body 202 of the off-axis PHA 104. The printhead body 202 has an upper surface on which alignment grooves 224 are provided to align with ribs 226 (FIG. 4) on a lower surface of the fluid conduit interconnect 204. The alignment ribs 226 are brought into engagement with the alignment grooves 224 to align fluid connecting elements 228 on the printhead body 202 to respective fluid connecting elements 230 on the fluid conduit interconnect 204. In other examples, other types of alignment elements can be provided on the fluid conduit interconnect 204 and the printhead body 202 to align the fluid conduit interconnect 204 with the printhead body 202.

The fluid connecting elements 230 of the fluid conduit interconnect 204 are depicted in greater detail in FIG. 5A, and the fluid connecting elements 228 of the printhead body 202 are depicted in greater detail in FIG. 5B.

In some examples, as shown in FIG. 5B, the fluid connecting elements 228 can each include a passageway and a needle 229 inside the passageway, where the needle 229 in the passageway can engage with a respective septum 231 of the corresponding fluid connecting element 230 of the fluid conduit interconnect 204, as shown in FIG. 5A. In alternative examples, needles can be provided in the fluid connecting elements 230, and septums can be provided in the fluid connecting elements 228. Although four fluid connecting elements 228/230 are depicted in the described examples, it is noted that in other examples, a different number of fluid connecting elements can be provided.

Once the alignment ribs 226 on the fluid conduit interconnect 204 are brought into alignment with the alignment grooves 224 of the printhead body 202, the fluid conduit interconnect 204 can be slid along the alignment grooves 224 until the fluid connecting elements 230 of the fluid conduit interconnect 204 are engaged with the fluid connecting elements 228 of the printhead body 202. A portion of the fluid conduit interconnect 204 is received in a receiving region 225 of the printhead body 202.

While the alignment grooves 224 and alignment ribs 226 provide coarse alignment, fine alignment elements can also be provided on the fluid conduit interconnect 204 and the printhead body 202 of the off-axis PHA 104. For example, the fluid conduit interconnect 204 includes fine alignment elements 240 that can engage with fine alignment elements 242 of the printhead body 202 as the fluid connecting elements 228/230 are brought into engagement with each other.

In some implementations, the fluid conduit interconnect 204 includes a latching mechanism 232 that has a moveable lever 234 (or other type of moveable member) that can be actuated by a user between an unlocked position (shown in FIGS. 2 and 4) and a locked position (shown in FIG. 3). Once the fluid connecting elements 230 of the fluid conduit interconnect 204 are brought into engagement with the fluid connecting elements 228 of the printhead body 202, the user can actuate the lever 234 of the latch mechanism 232 of the fluid conduit interconnect 204 from the unlocked position to the locked position (FIG. 3) to lock the fluid conduit interconnect 204 to the printhead body 202. In the locked position, the fluid connecting elements 228 and 230 can communicate printing fluid carried over the fluid conduit 106 and passed through the fluid conduit interconnect 202 to the printhead body 202.

In other implementations, the latching mechanism 232 can instead be provided on the printhead body 202.

Although an example fluid conduit interconnect 204 is depicted, it is noted that in other examples, the fluid conduit interconnect 204 can have a different arrangement for coupling the fluid conduit 106 to the printhead body 202.

As further shown in FIG. 4, a lower portion of the printhead body 202 includes printing fluid ejectors 250 for ejecting printing fluid toward the print medium 110 shown in FIG. 1.

Figure 6A:
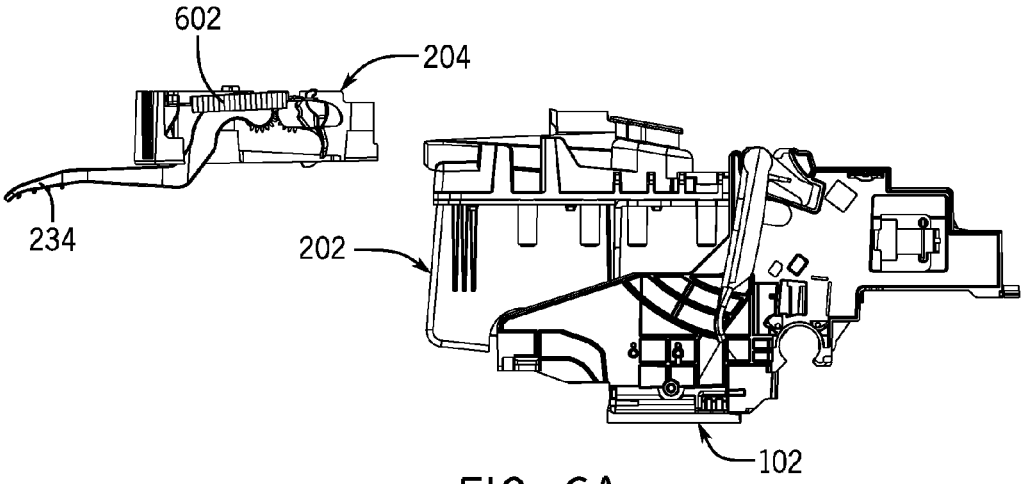
FIGS. 6A-6D illustrate an example of engaging a fluid conduit interconnect of the off-axis PHA to a printhead body of the off-axis PHA, according to some implementations.
Figure 6B:
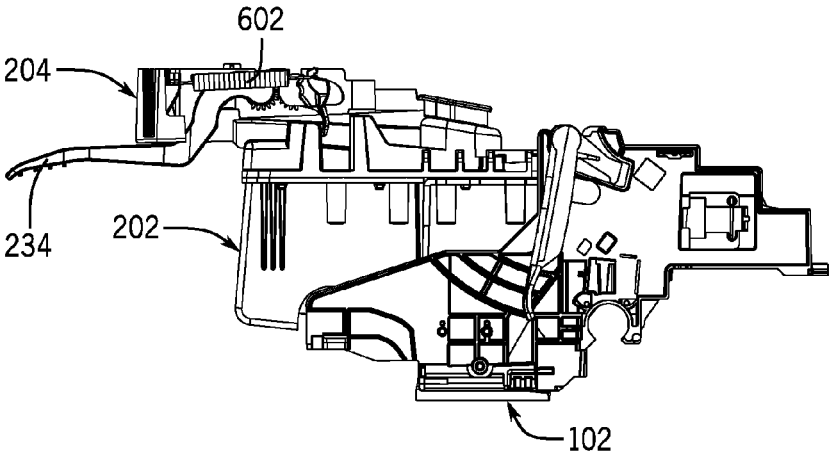

FIGS. 6A-6D are side views of the right side of the off-axis PHA 104 and the carriage 102. FIGS. 6A-6D illustrate various positions of the latch mechanism 232 of the fluid conduit interconnect 204 as the fluid conduit interconnect 204 is brought into engagement with the printhead body 202 (which in each of FIGS. 6A-6B is shown mounted in the carriage 102). In FIGS. 6A-6B, various outer housing portions have been removed from the fluid conduit interconnect 204 to depict components inside the fluid conduit interconnect 204.

In FIG. 6A, the fluid conduit interconnect 204 is initially separated from the printhead body 202.

In FIG. 6B, the fluid conduit interconnect 204 has been pushed into the receiving region 225 (FIG. 2) of the printhead body 202. Once the fluid conduit interconnect 204 has been pushed all the way into the receiving region 225 of the printhead body 202 and the fluid connecting elements 228/230 are engaged, the user can actuate the lever 234 of the latch mechanism 232 on the fluid conduit interconnect, to cause the septums 231 (FIG. 5A) of the fluid connecting elements 230 of the fluid conduit interconnect 204 to fully engage with the needles 229 of the fluid connecting elements 228 of the printhead body 202.

Figure 6C:
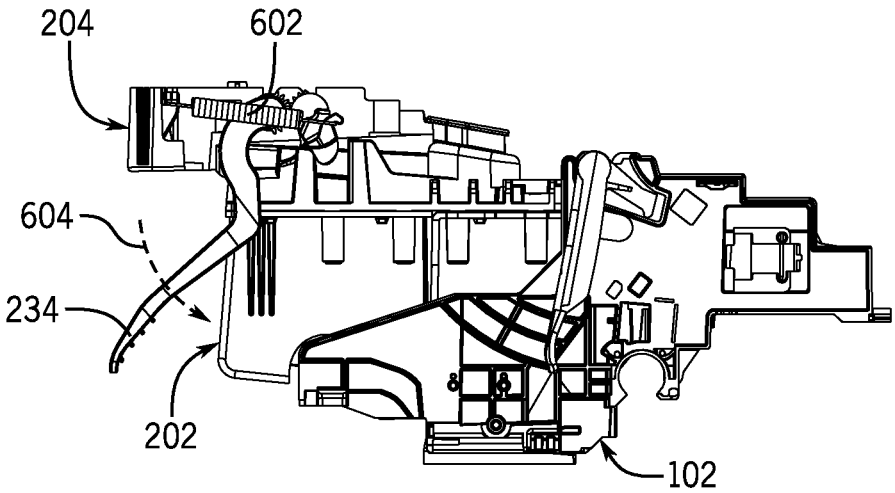
Figure 6D:
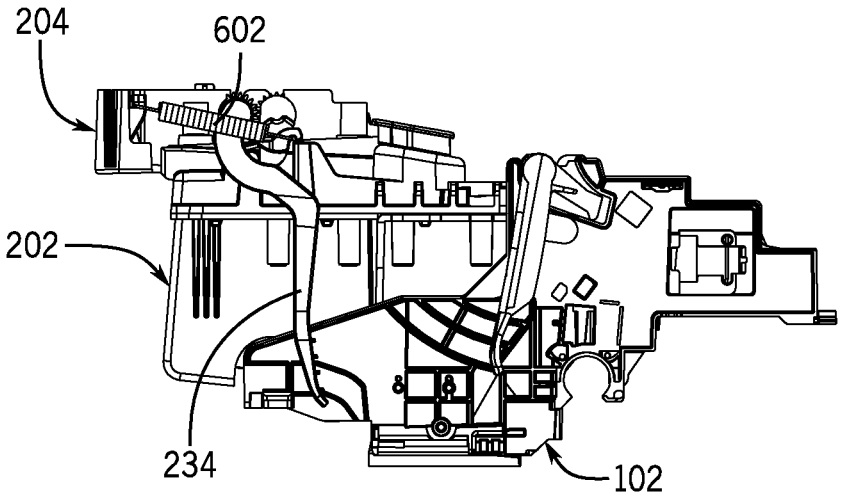

FIG. 6C shows the lever 234 at an intermediate position between the locked and unlocked position, and an arrow 604 showing the rotational movement of the lever 234. FIG. 6D shows the lever 234 pushed all the way to the locked position of the latch mechanism 232. A spring 602 is depicted as being connected to the lever 234 of the latch mechanism 232. The spring 602 provides a biasing element to bias the lever 234 to the unlocked position.

Figure 7A:
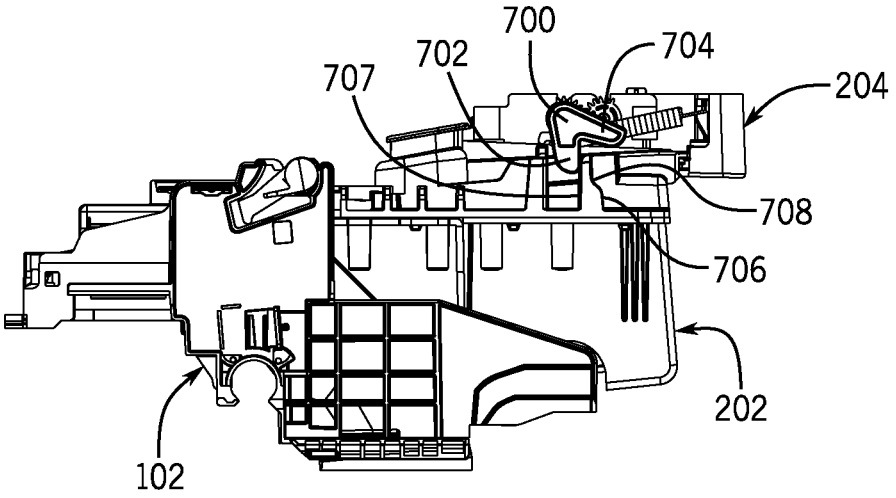
FIGS. 7A-7D illustrate an example of disengaging a fluid conduit interconnect of the off-axis PHA from a printhead body of the off-axis PHA, according to some implementations.

FIGS. 7A-7D are side views of the left side of the off-axis PHA 104 and the carriage 102. In FIG. 7A, the fluid conduit interconnect 204 is locked to the printhead body 202, which in turn is mounted in the carriage 102. As shown in FIG. 7A, a rotatable actuator 700 of the latch mechanism 232 (FIG. 4) includes a first lobe 702 and a second lobe 704. The rotatable actuator 700 is operatively coupled to the lever 234 such that the actuator 700 rotates in response to the rotation of the lever 234. The actuator 700 rotates in the clockwise direction in response to movement of the lever 234 being rotated in the direction indicated by an arrow 710 in FIG. 7B.

Figure 7B:
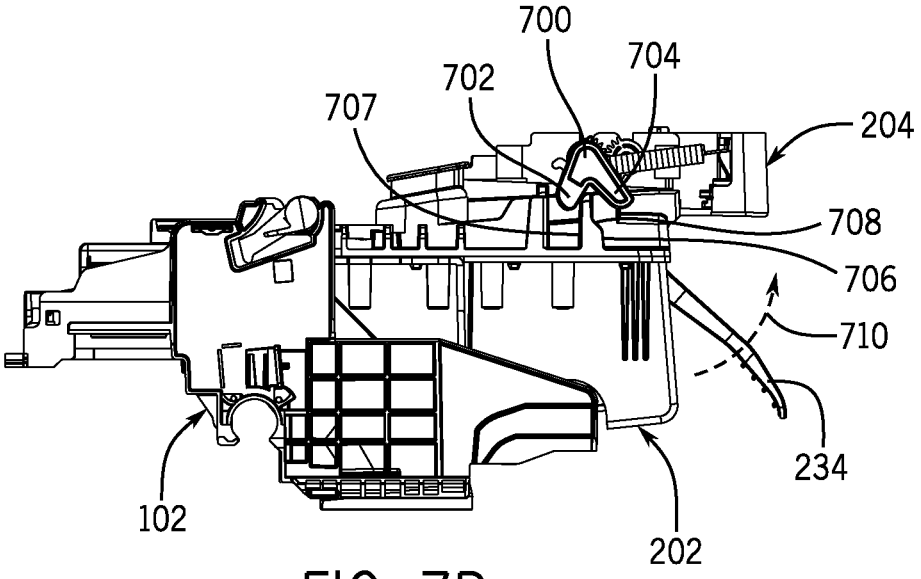

Initially, in the engaged position of FIG. 7A (where the fluid conduit interconnect 204 is locked to the printhead body 202), the lobe 702 of the actuator 700 is pressed against a first side 707 of a rib 704 of the printhead body 202. As shown in FIG. 7B, as the lever 234 is rotated by the user from the locked position to the unlocked position along rotational direction 710, the first lobe 702 of the actuator 700 disengages from the rib 704 of the printhead body 202.

Figure 7C:
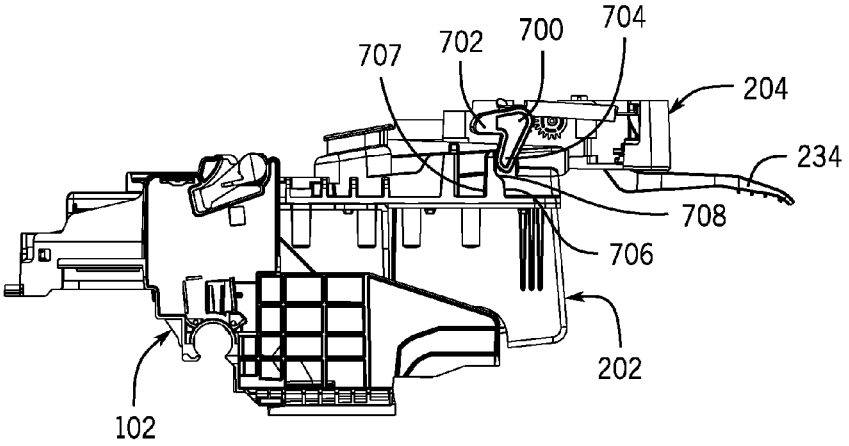

As the lever 234 is further rotated along direction 710, the second lobe 708 of the actuator 700 pushes against a second side 708 of the rib 704, as shown in FIG. 7C, which causes the fluid conduit interconnect 204 to disengage from the printhead body 202.

Figure 7D:
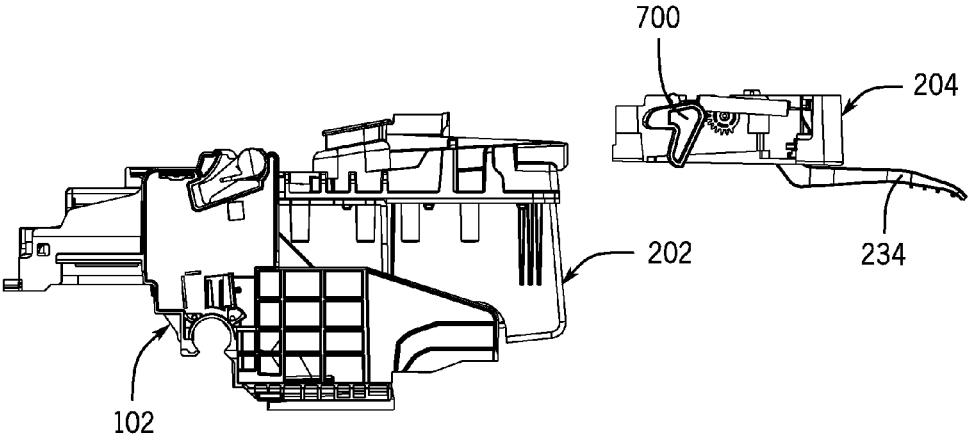

As a result, the septums 231 of the fluid connecting elements 230 of the fluid conduit interconnect 204 are released from the needles 229 of the fluid connecting elements 228 of the printhead body 202, so that the fluid conduit interconnect 102 can be removed from the printhead body 202, as shown in FIG. 7D.

Figure 8:
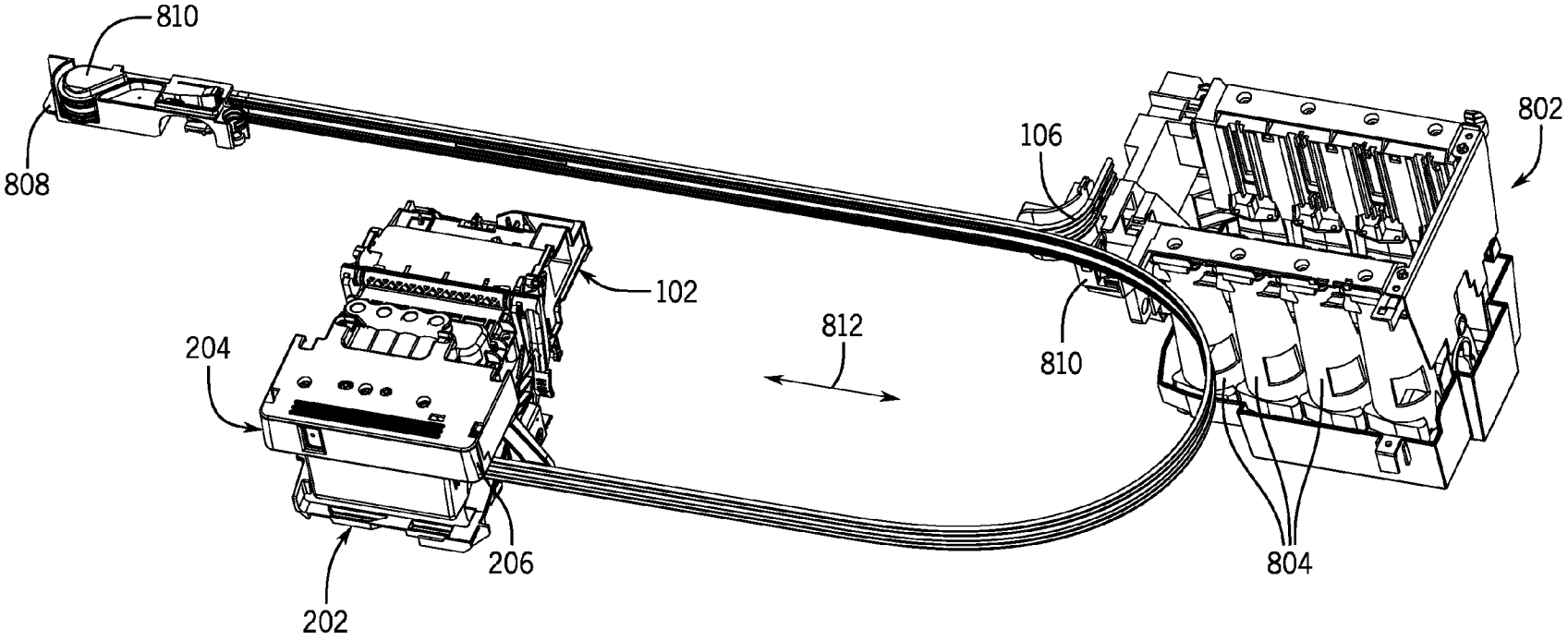
FIG. 8 illustrates an example ink supply station, an example turn-around assembly, and an example arrangement including a carriage and off-axis PHA, according to further implementations.

FIG. 8 shows example components of a printing system 800 according to further implementations. The printing system 800 can include a continuous ink supply system that has an ink supply station 802 with a number of ink supplies 804.

The ink supply station 802 is connected to the fluid conduit 106, which extends from the ink supply station 802 to a turn-around assembly 808. The fluid conduit 106 is received in a fluid conduit guide 810 of the turn-around assembly 808, which turns the fluid conduit 806 around to cause the fluid conduit 106 to extend through back to a retainer 810 of the ink supply station 802 and towards the fluid conduit interconnect 204 of the off-axis PHA 104. The fluid conduit 106 is connected to the fluid conduit interconnect 204 of the off-axis PHA 104, which is shown in FIG. 8 as being mounted in the carriage 102.

With the arrangement of FIG. 8, as the carriage 102 is moved back and forth along axis 812, the fluid conduit 806 can move inside the fluid conduit guide 810 of the turn-around assembly 808 to withdraw or extend the fluid conduit 806 as the carriage 102 moves back and forth along the axis 812.

In the arrangement of FIG. 8, the fluid conduit 106 is constrained at the connecting point to the fluid conduit interconnect 204 of the off-axis PHA 104, and also at the turn-around assembly 808. These constraint points can provide strain relief for the fluid conduit 106 during operation of the printing system 100 as the carriage 102 and attached off-axis PHA 104 is moved back and forth. Strain relief provides reduced strain on the fluid conduit 106 as the carriage 102 and the off-axis PHA 104 are moved back and forth.

Figure 9:
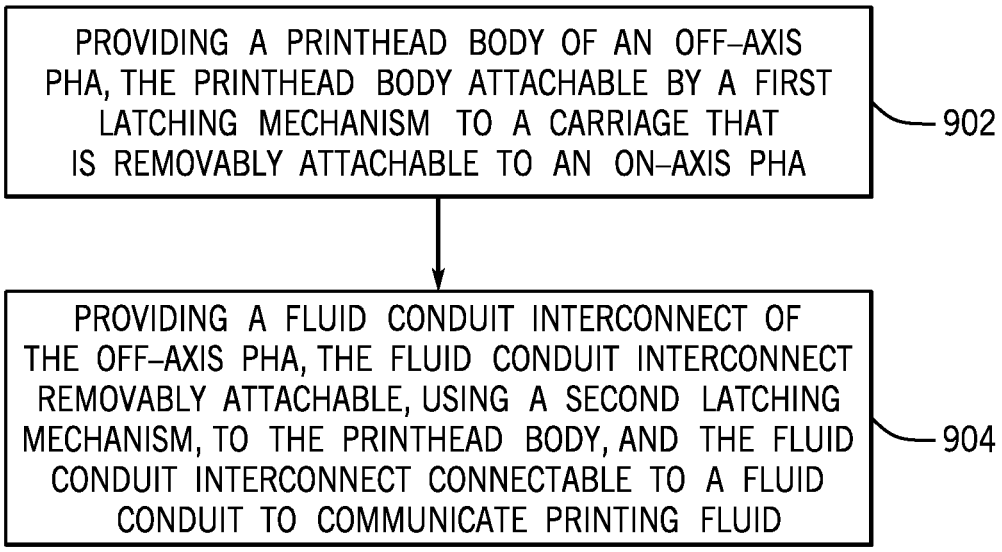
FIG. 9 is a flow diagram of an example process according to some implementations.

FIG. 9 is a flow diagram of an example process of forming an arrangement including the off-axis PHA 104 and the carriage 102, according to some implementations.

The process provides (902) the printhead body 202 of the off-axis PHA 104, the printhead body 202 attachable by a first latching mechanism to the carriage 102, where the carriage 102 is removably attachable to an on-axis PHA.

The process provides (at 904) the fluid conduit interconnect 204 of the off-axis PHA 104, the fluid conduit interconnect 204 removably attachable, using a second latching mechanism, to the printhead body 202, and the fluid conduit interconnect 204 connectable to the fluid conduit 106 to communicate printing fluid from at least one off-axis printing fluid supply through the fluid conduit interconnect 204 to the printhead body 202.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. An off-axis printhead assembly comprising:

a printhead body of the off-axis printhead assembly comprising an engagement element removably attachable to an attachment mechanism of a carriage of a printing system, the attachment mechanism of the carriage removably attachable to an on-axis printhead assembly, wherein the printhead body comprises a first fluid connecting element and has an upper surface comprising first alignment elements; and a fluid conduit interconnect removably attached to the printhead body, the fluid conduit interconnect to connect to a fluid conduit to communicate printing fluid from at least one off-axis printing fluid supply through the fluid conduit interconnect to the printhead body, wherein the fluid conduit interconnect comprises a second fluid connecting element and second alignment elements, the second alignment elements to slide along the first alignment elements to align the first fluid connecting element of the printhead body with the second fluid connecting element of the fluid conduit interconnect when the fluid conduit interconnect is brought into engagement with the printhead body to engage the first fluid connecting element and the second fluid connecting element.

2. The off-axis printhead assembly of claim 1, wherein the attachment mechanism comprises a first latching mechanism, and wherein the engagement element is engageable with the first latching mechanism.

3. The off-axis printhead assembly of claim 2, wherein the engagement element is engageable with the first latching mechanism that includes a moveable member that is user actuatable between an unlocked position and a locked position, the unlocked position allowing for detachment of the off-axis printhead assembly from the carriage, and the locked position to secure the off-axis printhead assembly to the carriage.

4. The off-axis printhead assembly of claim 2, further comprising a second latching mechanism to removably attach the fluid conduit interconnect to the printhead body.

5. The off-axis printhead assembly of claim 4, wherein the second latching mechanism is provided on the fluid conduit interconnect.

6. The off-axis printhead assembly of claim 4, wherein the second latching mechanism includes a moveable member that is user actuatable between an unlocked position and a locked position, the unlocked position allowing for detachment of the fluid conduit interconnect from the printhead body, and the locked position to secure the fluid interconnect to the printhead body.

7. The off-axis printhead assembly of claim 1, wherein the printhead body includes an alignment element to align the printhead body with the fluid conduit interconnect as a fluid connecting element of the printhead body is brought into engagement with a fluid connecting element of the fluid conduit interconnect.

8. The off-axis printhead assembly of claim 1, wherein the fluid conduit interconnect comprises a rotatable actuator rotatable between different positions to respectively lock and unlock the fluid conduit interconnect to the printhead body.

9. The off-axis printhead assembly of claim 1, wherein the first fluid connecting element comprises one of a needle and a septum, and the second fluid connecting element comprises another one of a needle and a septum.

10. The off-axis printhead assembly of claim 1, wherein the first fluid connecting element is separate from the first alignment elements, and the second fluid connecting element is separate from the second alignment elements.

11. A printing system comprising:

a carriage;

an off-axis printhead assembly comprising:

a printhead body comprising an engagement element removably attachable by a first latching mechanism to the carriage, the carriage designed to receive an on-axis printhead assembly, wherein the printhead body comprises a first fluid connecting element and has an upper surface comprising first alignment elements; and a fluid conduit interconnect removably attached to the printhead body, the fluid conduit interconnect to connect to a fluid conduit to communicate printing fluid from at least one off-axis printing fluid supply through the fluid conduit interconnect to the printhead body, wherein the fluid conduit interconnect comprises a second fluid connecting element and second alignment elements, the second alignment elements to slide along the first alignment elements to align the first fluid connecting element of the printhead body with the second fluid connecting element of the fluid conduit interconnect when the fluid conduit interconnect is brought into engagement with the printhead body to engage the first fluid connecting element and the second fluid connecting element.

12. The printing system of claim 11, further comprising a second latching mechanism to removably attach the fluid conduit interconnect to the printhead body.

13. The printing system of claim 11, further comprising the at least one off-axis printing fluid supply.

14. The printing system of claim 11, wherein the carriage comprises a receptacle to receive the printhead body from a front of the carriage rather than from a top of the carriage.

15. The printing system of claim 11, wherein the carriage is moveable with respect to a print target onto which the off-axis printhead assembly is to eject printing fluid.

16. The printing system of claim 11, further comprising a turn-around assembly through which the fluid conduit is guided from the at least one off-axis printing fluid supply, the turn-around assembly and the fluid conduit interconnect to constrain the fluid conduit to provide strain relief.

17. The printing system of claim 11, wherein the fluid conduit interconnect comprises a rotatable actuator rotatable between different positions to respectively lock and unlock the fluid conduit interconnect to the printhead body.

18. The printing system of claim 11, wherein the first fluid connecting element is separate from the first alignment elements, and the second fluid connecting element is separate from the second alignment elements.

19. A method comprising:

providing a printhead body of an off-axis printhead assembly, the printhead body attachable by a first latching mechanism to a carriage of a printing system, the carriage removably attachable to an on-axis printhead assembly, wherein the printhead body comprises a first fluid connecting element and has an upper surface comprising first alignment elements;

providing a fluid conduit interconnect of the off-axis printhead assembly, the fluid conduit interconnect removably attachable, using a second latching mechanism, to the printhead body, and the fluid conduit interconnect connectable to a fluid conduit to communicate printing fluid from at least one off-axis printing fluid supply through the fluid conduit interconnect to the printhead body, wherein the fluid conduit interconnect comprises a second fluid connecting element and second alignment elements, the second alignment elements to slide along the first alignment elements to align the first fluid connecting element of the printhead body with the second fluid connecting element of the fluid conduit interconnect when the fluid conduit interconnect is brought into engagement with the printhead body to engage the first fluid connecting element and the second fluid connecting element.

20. The method of claim 19, further comprising providing the fluid conduit interconnect with a rotatable actuator that is rotatable between different positions to respectively lock and unlock the fluid conduit interconnect to the printhead body.

* * * * *